US011326372B2

(12) United States Patent
Basavarajappa

(10) Patent No.: US 11,326,372 B2
(45) Date of Patent: May 10, 2022

(54) INERTIA LOCKING MECHANISM FOR MOTOR VEHICLE DOOR LATCH

(71) Applicant: Kiekert AG, Heiligenhaus (DE)

(72) Inventor: Madhu S. Basavarajappa, Düsseldorf (DE)

(73) Assignee: Kiekert AG, Heiligenhaus (DE)

( * ) Notice: Subject to any disclaimer, the term of this patent is extended or adjusted under 35 U.S.C. 154(b) by 830 days.

(21) Appl. No.: 16/095,402

(22) PCT Filed: Mar. 24, 2017

(86) PCT No.: PCT/DE2017/100244
§ 371 (c)(1),
(2) Date: May 21, 2019

(87) PCT Pub. No.: WO2017/182027
PCT Pub. Date: Oct. 26, 2017

(65) Prior Publication Data

US 2019/0271178 A1 Sep. 5, 2019

(30) Foreign Application Priority Data

Apr. 22, 2016 (DE) ..... 10 2016 107 510.8

(51) Int. Cl.
*E05B 77/06* (2014.01)
*E05B 83/36* (2014.01)

(52) U.S. Cl.
CPC ..... *E05B 77/06* (2013.01); *E05B 83/36* (2013.01); *E05Y 2900/531* (2013.01)

(58) Field of Classification Search
CPC ... E05B 77/06; Y10T 292/1047; Y10S 292/22
(Continued)

(56) References Cited

U.S. PATENT DOCUMENTS 6,971,688 B2 * 12/2005 Drysdale ..... E05B 77/06 292/216
9,637,952 B2 * 5/2017 Wittelsbuerger ..... E05B 77/06
(Continued)

FOREIGN PATENT DOCUMENTS

CN 104420741 A * 3/2015 ..... E05B 77/04
DE 19624640 1/1998
(Continued)

OTHER PUBLICATIONS

International Search Report and Written Opinion for corresponding Patent Application No. PCT/DE2017/100244 dated Jun. 27, 2017.

*Primary Examiner* — Kristina R Fulton
*Assistant Examiner* — Emily G. Brown
(74) *Attorney, Agent, or Firm* — Renner, Otto, Boisselle & Sklar, LLP

(57) ABSTRACT

A motor vehicle door lock comprises a ratchet-type mechanism having a pawl and a rotary latch. The motor vehicle door lock is also provided with a release lever for the ratchet-type mechanism and at least one actuation lever and a blocking element. The blocking element brings about a mechanical connection during normal operation and a mechanical separation, when operating in the event of an accident, between the actuation lever and the release lever. According to the invention, the blocking element is configured as a coupling lever mounted on the actuation lever, which pivots independently from the actuation lever applied with spring force when operating in the event of an accident.

16 Claims, 2 Drawing Sheets

(58) Field of Classification Search
USPC ..... 292/216
See application file for complete search history.

(56) References Cited

U.S. PATENT DOCUMENTS

| | | | | |
|---|---|---|---|---|
| 11,180,933 | B2 * | 11/2021 | Taga | E05B 85/02 |
| 2013/0328325 | A1 | 12/2013 | Uehara et al. | |
| 2014/0284943 | A1 * | 9/2014 | Wittelsbuerger | E05B 77/06 292/92 |
| 2014/0284944 | A1 * | 9/2014 | Rosales | E05B 85/26 292/113 |
| 2016/0258194 | A1 * | 9/2016 | Rosales | E05B 77/06 |

FOREIGN PATENT DOCUMENTS

| | | | | |
|---|---|---|---|---|
| DE | 202009009061 | U1 * | 12/2010 | E05B 77/06 |
| DE | 102014001123 | A1 | 7/2015 | |
| WO | 2006114084 | A1 | 11/2006 | |
| WO | 2011110142 | | 9/2011 | |
| WO | 2012013182 | | 2/2012 | |

* cited by examiner

INERTIA LOCKING MECHANISM FOR MOTOR VEHICLE DOOR LATCH

FIELD OF DISCLOSURE

The invention relates to a motor vehicle door lock with a locking mechanism substantially consisting of a pawl and a rotary latch, furthermore with a release lever for the locking mechanism, and with at least one operating lever and a blocking element, whereby the blocking element in normal operation causes a mechanical connection and in accident operation causes mechanical separation between the actuation lever and the release lever.

BACKGROUND OF DISCLOSURE

In the class-specific state of the art according to DE 196 24 640 C1 a blocking lever is provided for which is mounted on an external actuation lever. In accident operation, the blocking lever is deflected against the force of a spring. The external actuation lever is thus blocked and ultimately causes the desired mechanical separation between the actuation lever or the external actuation lever and a pertaining release lever.

In fact, normal operation, as generally customary, corresponds to no excessive crash-induced accelerations being observed on the relevant motor vehicle door lock. This means in particular deflection of the actuation lever occurs individually and solely in normal operation by impingement, for example, of a pertaining handle which is mechanically connected to the relevant actuation lever. In fact, the external actuation lever is mechanically connected to an external door handle within the scope of DE 196 24 640 C1 in this context.

A comparable motor vehicle door lock is described in WO 2012/013182 A2. In this case, too, impingement of an actuation lever mechanism or the actuation lever in normal operation ensures that the actuation lever works directly or indirectly on the release lever which, for its part, in the general case lifts a pawl which is engaged with a rotary latch from the rotary latch. The locking mechanism is thus opened. As a consequence hereof, the rotary latch pivots the usually spring-assisted impinged rotary latch and a previously arrested locking bolt is released. The same applies to a motor vehicle door equipped with the relevant motor vehicle door lock.

However, if, in deviation from normal operation, accident operation occurs, high acceleration forces thus usually occur which are a multiple of the acceleration of gravity, for example 5 g, 10 g or even more. In such a case, mass forces act on the relevant motor vehicle door lock which can correspond to an unintended impingement of the actuation lever. As a consequence hereof, it is conceivable that the locking mechanism is opened in an unintended manner. In order to prevent this, the blocking element in the described accident operation ensures mechanical separation between the relevant actuation lever and the release lever.

For this purpose, in the known theory according to WO 2012/013182 A2 a blocking lever is provided for which mechanically disables the actuation lever mechanism in accident operation. A blocking means is assigned to the blocking lever which fixes the blocking lever in its deflected position. In this case too a blockage of the actuation lever mechanism ultimately occurs and consequently the actuation lever as in DE 196 24 640 C1.

The state of the art has fundamentally been proven when it is a case of being able to differentiate between normal operation and accident operation and to cause an effective mechanical separation between the actuation lever and the release lever in accident operation. However, the known solutions are often distinguished by the actuation lever being involved in the functional sequence. A spring assigned to the actuation lever is thus often configured with relatively strength or the operating forces for the actuation lever are high in normal operation. This is often viewed as disadvantageous for convenience reasons.

SUMMARY OF DISCLOSURE

The invention is based on the technical problem of thus further developing such a motor vehicle door lock that any operating forces on the actuation lever are reduced in normal operation with an unchangedly effective and functional differentiation between normal operation and accident operation.

To solve this technical problem, a class-specific motor vehicle door lock within the scope of the invention is characterized in that the blocking element is formed as a coupling lever mounted on the actuation lever, which pivots in accident operation independently of the actuation lever acted on by spring force.

According to the invention, the actuation lever is therefore initially not or practically not included into the functional sequence during accident operation.

Instead, impingement of the actuation lever occurs predominantly in normal operation. Accident operation corresponds to the actuation lever remaining largely at rest and only pivots the coupling lever relatively to the actuation lever and independently of the actuation lever as a result of the attacking mass forces. As a consequence hereof, an actuation lever spring assigned to the actuation lever can be configured weakly viewed from its spring force, typically has a spring force which is considerably less compared to the state of the art.

Because the actuation lever ultimately does not need to withstand the acceleration forces in accident operation, but remains practically at rest. Only the blocking element formed as a coupling lever pivots in respect of the actuation lever. However, should the actuation lever pivot in accident operation, the previously already pivoted coupling lever thus ensures the desired mechanical disruption to the release lever. The locking mechanism remains at rest in any case.

As a consequence hereof, the actuation lever spring assigned to the actuation lever must only be equipped with a spring force which ensures that the actuation lever can be reset into its rest position perfectly in normal operation. The connected spring force is typically low. Because ultimately the actuation lever spring must only reset a connecting means and, if necessary, a handle provided for on the end side of the connecting means in normal operation, for example together with the actuation lever. The required moments on the actuation lever or on a pivot axis of the actuation lever are usually low so that the actuation lever spring can also be equipped with relatively little spring force compared to the state of the art. As a consequence hereof, any operating forces on the actuation lever or the handle acting on the actuation lever are also reduced compared to the state of the art. These are the fundamental advantages.

The coupling lever is also generally acted on by spring force. For this purpose, the coupling lever is typically equipped with its own coupling lever spring. Furthermore, the configuration is such that the coupling lever pivots against the spring force of the coupling lever spring. If accident operation therefore occurs, the blocking element configured as a coupling lever within the scope of the invention pivots against the force of the coupling lever spring. The configuration is usually also such that the coupling lever in accident operation is formed as bilaterally pivotable compared to the release lever in accident operation.

This means that in accident operation the coupling lever can pivot in two opposite directions compared to its position in normal operation, for example forwards/backwards or right/left. Thus, in accident operation by the coupling lever ultimately both positive and negative accelerations are implemented into relevant movement of the coupling lever. In positive accelerations the coupling lever can, for example, stop on a stop of a housing pertaining to the motor vehicle door lock. In contrast, a movement of the coupling lever can then correspond to the coupling lever pivoting into a vacuum as a result of negative acceleration. The procedure can naturally also take place vice versa. In both cases, it is guaranteed that the coupling lever is disengaged from the release lever in any case in the respective accident operation. An unintended impingement of the release lever for example by the nevertheless pivoted actuation lever is consequently not possible in accident operation in both cases.

In order to execute this in detail, generally the actuation lever including the mounted coupling lever on the one hand and the release lever on the other hand are arranged at an angle. Usually a right-angled arrangement has proven especially beneficial here. It is predominantly proceeded in such a way that the actuation lever including the coupling lever mounted thereon are largely arranged in a motor vehicle transverse direction or X-direction. In contrast, the release lever predominantly has an arrangement in a motor vehicle lengthwise direction or Y direction. The motor vehicle vertical axis direction pertains to the Z-direction as generally known. In the case of a lateral impact, relevant acceleration forces consequently act in the X-direction and ensure that the coupling lever is pivoted.

As the actuation lever including the mounted coupling lever is largely arranged in the motor vehicle transverse direction or X-direction in an advantageous embodiment, in accident operation and acceleration forces occurring in the case of a lateral impact correspond to the case, for example, of positive acceleration forces to impingement in the X-direction. In contrast, negative acceleration forces pertain to impingement in the X-direction. This applies at least as an example. Because a lateral impact is typically associated with a relevant negative or positive acceleration in the motor vehicle transverse direction or X-direction.

Furthermore, it is regularly proceeded in such a way that the coupling lever interacts with a ramped edge on the release lever in normal operation. For this purpose, the coupling lever is usually equipped with a relevant ramped contour, which in normal operation acts on the ramped edge on the release lever such that the release lever is pivoted around its pertaining pivot axis. The pivoting movement of the release lever around its pivot axis usually has the direct or indirect consequence that the pawl as a component of the locking mechanism substantially consisting of the pawl and the rotary latch is lifted from the rotary latch. In fact, the rotary latch is held with the aid of the pawl in the closed position of the motor vehicle door lock.

If now in this closed position of the motor vehicle door lock or the pertaining locking mechanism the pawl is lifted from the rotary latch, the rotary latch can thus open in a spring-assisted manner and release a previously arrested locking bolt. The motor vehicle door lock is opened. Furthermore, a pertaining motor vehicle door can also pivot open. This corresponds to a customary opening process in normal operation.

If, in contrast, a crash or accident operation occurs, the actuation lever thus predominantly remains at rest. In contrast, the coupling lever mounted on the actuation lever is pivoted independently of the actuation lever. As a consequence hereof, the ramped contour on the coupling lever can no longer interact with the ramped edge on the release lever. The release lever and also the locking mechanism thus remains at rest and an unintentional opening of the motor vehicle door lock does not explicitly occur.

In order to act on the actuation lever in normal operation, this is generally equipped with a stop element for a connecting means. The connecting means ensures for its part mechanical coupling of the actuation lever with a handle. If the handle is an external handle, the actuation lever is thus configured as an external actuation lever. The connecting means can be a Bowden cable or similar. A rod connection between the relevant handle and the actuation lever is also encompassed by the invention. The stop element on the actuation lever now ensures mechanical coupling of the connecting means with the actuation lever. Thus, impingement of the handle via the connecting means is transferred to the actuation lever.

As a consequence hereof, the actuation lever is pivoted around its pivot axis. In normal operation, this process corresponds to the ramped contour on the coupling lever interacting with the ramped edge on the release lever so that the release lever is pivoted around its pivot axis and hereby lifts the pawl from the rotary latch.

The previously described stop element on the actuation lever is advantageously formed simultaneously as a stop for a spring leg of the actuation lever spring. In fact, the actuation lever spring is usually a leg spring. One spring leg of the actuation lever spring lies adjacent on the relevant stop which assumes the described dual function as a stop for the relevant spring leg and simultaneously as a mechanical coupling element for the connecting means. The other spring leg is usually braced on the housing of the motor vehicle door lock.

Thus, impingement of the actuation lever with the aid of the handle with intermediate switching of the connecting means or the Bowden cable ensures that the relevant actuation lever spring or leg spring is (slightly) pre-tensioned in normal operation. As soon as an operator no longer acts on the relevant handle, the handle is reset together with the connecting means and the actuation lever with the aid of the relevant actuation lever spring. Slight spring forces of the actuation lever spring are sufficient which consequently also correspond to facilitated operation of the handle and consequently the actuation lever.

Ultimately, it has been proven when the actuation lever is formed largely as a U-shape overall with the mounted coupling lever. This means that the actuation lever and the coupling lever mounted thereon initially span a common plane. The plane spanned by the actuation lever including the coupling lever mounted thereon extends largely in the motor vehicle transverse direction or X-direction, because the actuation lever and the coupling lever are largely arranged in precisely this motor vehicle transverse direction.

The actuation lever is now for its part usually L-shaped or reverse L-shaped, whereby the long L-leg carries the stop element for the connecting means. This stop element is usually connected to this on the end side of the long L-leg. In contrast, the pivot axis for the coupling lever is located on the end side of the short L-leg of the L-shaped or reverse L-shaped actuation lever. As the coupling lever for its part is largely extended in the lengthwise direction, the overall predominantly U-shaped form of the actuation lever is clarified with the coupling lever mounted thereon.

As a consequence hereof, a pivoting movement of the L-shaped or reverse L-shaped actuation lever directly results in the coupling lever steered on the end of the short L-leg pivotably on the actuation lever executing a predominantly linear movement. In normal operation, this linear movement corresponds to the ramped contour on the coupling lever being able to interact with the ramped edge on the release lever.

However, in accident operation, as soon as the coupling lever is pivoted opposite and independently of the actuation lever, this automatically leads to the ramped contour on the coupling lever no (longer) being able to interact with the ramped edge on the release lever. Because the ramped contour and the ramped edge are predominantly arranged at a right angle to one another. Thus, a pivoting of the coupling lever and consequently the ramped contour provided for on both sides of the position in normal operation leads to the ramped contour no longer attaining or being unable to attain the ramped edge on the release lever. The release lever and consequently the locking mechanism therefore remain in accident operation as desired at rest.

As a result, a motor vehicle door lock is provided which initially manages with a small number of structural elements. Because the blocking element for execution of accident operation is formed as a coupling lever mounted on the actuation lever. Furthermore, the configuration is such that the actuation lever in accident operation practically remains at rest. In contrast, the coupling lever mounted on the actuation lever pivots opposite the actuation lever and independently hereof. Thus, the spring force of the actuation lever spring assigned to the actuation lever can be low and the operating forces on the actuation lever are also small. This leads to considerable improvements in convenience compared to the state of the art. These are the fundamental advantages.

BRIEF DESCRIPTION OF DRAWINGS

The invention is explained in further detail hereafter on the basis of a drawing which only constitutes an exemplary embodiment. The following are shown.

DETAILED DESCRIPTION

Figure 1:
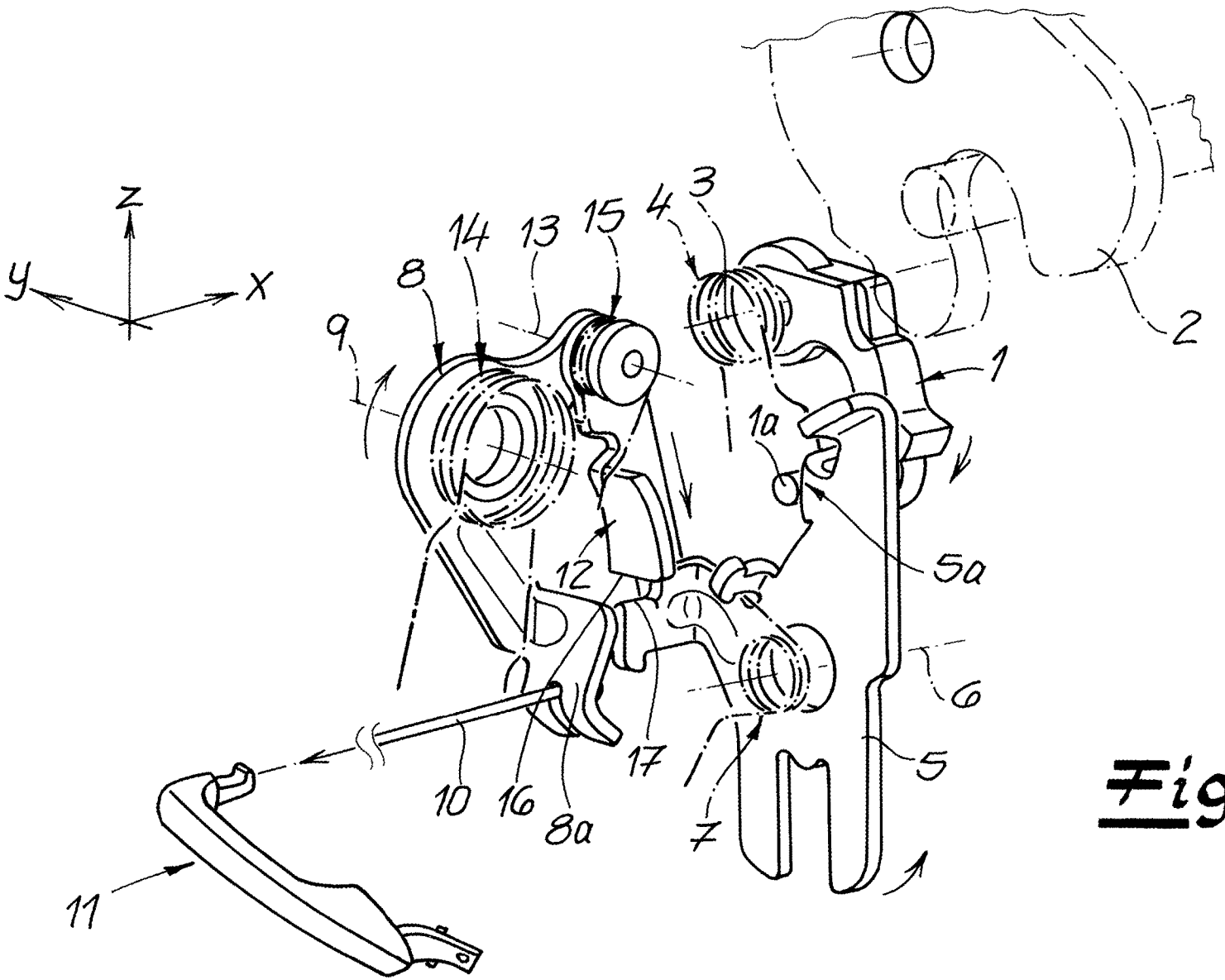
FIG. 1 the motor vehicle door lock according to the invention in a diagrammatic perspective view reduced to the components which are fundamental for the invention and FIG. 2 the actuation lever including coupling lever in different functional positions.

In the figures a motor vehicle door lock is illustrated which comprises, as is customary, a locking mechanism 1, 2 substantially consisting of a pawl 1 and a rotary latch 2 which is only implied. The pawl 1 can be pivoted around a pivot axis 3 implied in FIG. 1 against the force of a spring 4. A pivoting movement of the pawl 1 around the pivot axis 3 in a clockwise direction implied in FIG. 1 corresponds to the implied rotary latch 2 being opened against spring force. A locking bolt which was previously arrested and only implied is released with the aid of the rotary latch 2. The motor vehicle door lock is then opened.

A release lever 5 is provided for to act on the pawl 1. For its part, the release lever 5 has a pivot axis 6 and a pertaining spring 7 which is of rather subordinate importance for the following observations, however. As soon as the release lever 5 executes and can execute a pivoting movement around its pivot axis 6 in the implied anti-clockwise direction, an edge 5*a* on the release lever 5 becomes adjacent on a pin 1*a* of the pawl 1 and ensures that the pawl 1 is pivoted around its axis or pivot axis 3 in the implied clockwise direction so that the locking mechanism 1, 2 experiences the previously described opening.

An actuation lever 8 is then illustrated in FIG. 1. The actuation lever 8 can be pivoted around an axis or pivot axis 9. Such pivoting movements in normal operation correspond to the actuation lever 8 executing a clockwise movement around the relevant axis or pivot axis 9, as also implied in FIG. 1. In order to initiate this clockwise direction movement of the actuation lever 8 formed as an external actuation lever in the present case, the actuation lever 8 is mechanically connected to a handle 11 by means of a connecting means 10. The handle 11 is an external handle or an external door handle, so that the actuation lever 8 is configured as an external actuation lever. Naturally, the actuation lever 8 can also be an internal actuation lever. Then the handle 11 is formed as an internal handle or internal door handle which is not illustrated in the present case, however.

A blocking element 12 is pivotably mounted on the actuation lever 8, which involves a coupling lever 12 in the exemplary embodiment. The pivotable accommodation of the blocking element or coupling lever 12 on the actuation lever 8 corresponds to an axis or pivot axis 13. Finally, an actuation lever spring 14 is apparent on the one hand and a coupling lever spring 15 on the other hand.

Both the actuation lever spring 14 and also the coupling lever spring 15 are respectively formed as leg springs. This means that both springs 14,15 have two end-sided spring legs 14*a*, 14*b* or 15*a*, 15*b*, which protrude from a wound central section 14*c* or 15*c*. The relevant central section 14*c* or 15*c* from circular coils respectively is arranged and oriented concentrically compared to the pertaining pivot axis 9 or 13. The spring force of the actuation lever spring 14 is greater than the spring force of the coupling lever spring 15.

The actuation lever 8 has an end-sided stop element 8*a*. The stop element 8*a* functions simultaneously as a stop for one spring leg 14*a* of the actuation lever spring 14. The other spring leg 14*b* of the actuation lever spring 14 is braced in contrast on a stop of a housing for the motor vehicle door lock shown in contrast. The coupling lever spring 15 is configured and arranged in such a way that one spring leg 15*a* is braced on the actuation lever 8, while the other spring leg 15*b* acts on the coupling lever 12. This is apparent in particular on the basis of the enlarged detailed illustration in FIG. 2.

On the basis of this illustration, it is also clear that the stop element 8*a* is connected on the end side to a long L-leg of the L-shaped or reverse L-shaped actuation lever 8. The pivot axis 9 of the actuation lever 8 is located in the connecting area of these two L-legs. On the short L-leg of the L-shaped actuation lever 8 the coupling lever or blocking element 12 is pivotably connected on the end side. This means that the pertaining axis or pivot axis 13 of the coupling lever 12 is located on the end side of the short L-leg of the L-shaped actuation lever 8.

Figure 2:
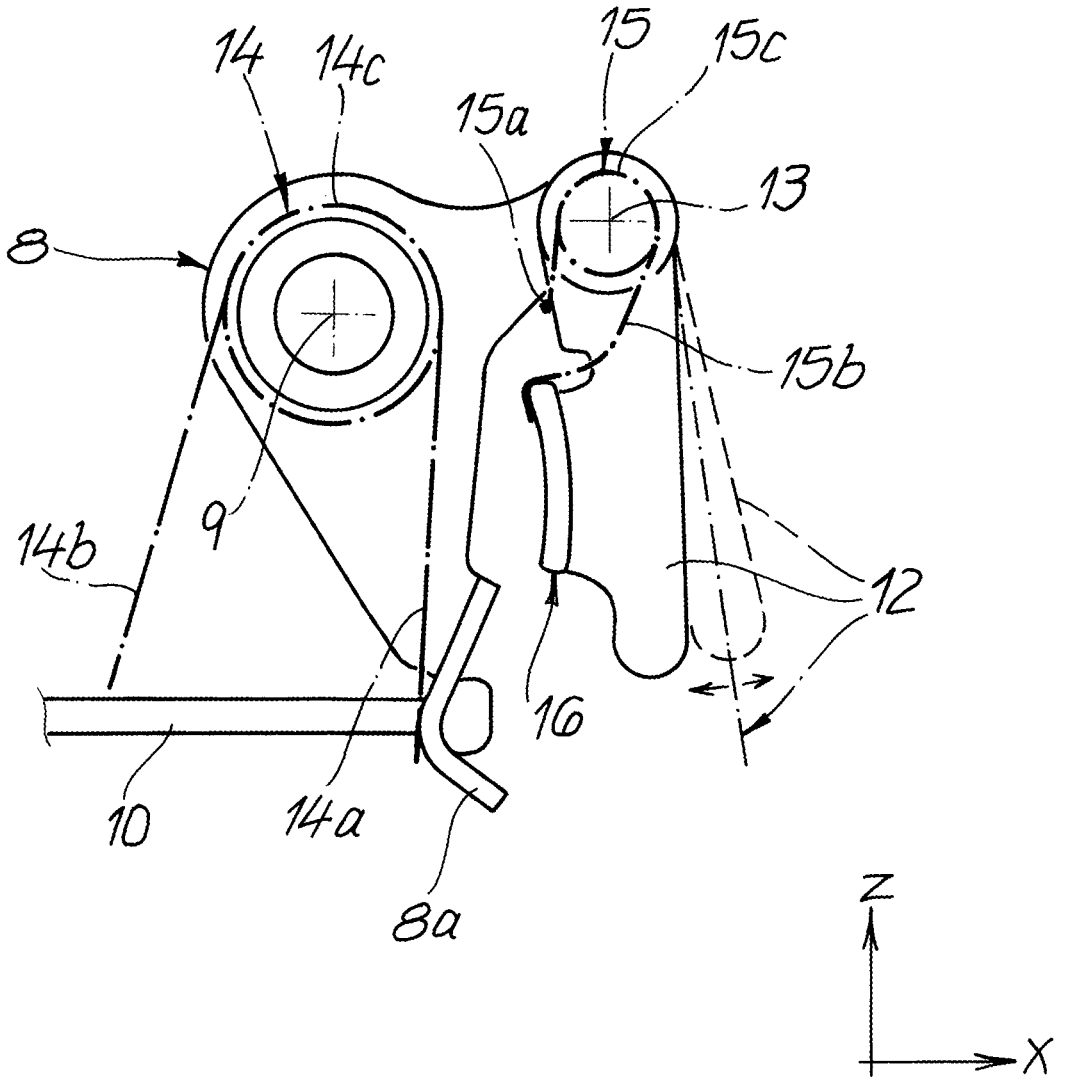

In the enlarged illustration according to FIG. 2 a ramped contour 16 is then apparent on the coupling lever 12, which interacts with a ramped edge 17 on the release lever 5 in normal operation. The ramped edge 17 on the release lever 5 and the ramped contour 16 on the coupling lever 12 are respectively arranged at a right angle to one another.

On the basis of FIG. 1, it is also apparent that the actuation lever 8 including the coupling lever 12 mounted thereon on the one hand and the release lever 5 on the other hand are arranged at an angle to one another. In fact, the actuation lever 8 and also the coupling lever 12 mounted thereon are largely arranged in a motor vehicle transverse or X-direction. This means that the actuation lever 8 and the coupling lever 15 mounted thereon span a common plane which is predominantly arranged in the relevant motor vehicle transverse direction or X-direction and extends in this direction. In contrast, the release lever 5 is predominantly arranged in the motor vehicle lengthwise direction or Y-direction.

From a comparative observation of FIGS. 1 and 2 it also results that the ramped contour 16 on the coupling lever 12 predominantly has an arrangement in the motor vehicle lengthwise direction or Y-direction. In contrast, the ramped edge 17 on the release lever 5 extends in the motor vehicle transverse direction or X-direction so that the previously already described angular or right angular orientation becomes clear between the ramped contour 16 on the coupling lever 12 on the one hand and the ramped edge 17 on the release lever 5 on the other hand.

It operates as follows. In normal operation illustrated in FIG. 1, an impingement of the handle 11 or the external door handle executed here ensures that the connecting means 10 is acted on in an arrow direction in the tension illustrated in FIG. 1. Because the connecting means 10 attacks on the stop element 8*a* of the actuation lever 8, the tension attacking on the connecting means 10 and the tension illustrated by the arrow ensures that the actuation lever 8 is pivoted around its axis or pivot axis 9 in the depicted clockwise direction.

As the actuation lever 8 including the coupling lever 12 mounted thereon is largely formed as a U-shape, this pivoting movement of the actuation lever 8 leads in normal operation to the coupling lever 12 being moved downwards in a linear manner in the arrow direction illustrated in FIG. 1. The ramped contour 16 of the actuation lever 8 thus stops on the ramped edge 17 of the release lever 5. As a consequence hereof, the release lever 5 is pivoted around its axis or pivot axis 6 in the anti-clockwise direction. The edge 5*a* of the release lever 5 thus travels against the pin 1*a* of the pawl 1, so that at the end of this functional sequence the pawl 1 is pivoted around its axis or pivot axis 3 in the clockwise direction illustrated in FIG. 1. The pawl 1 is thus released by the rotary latch 2 so that the rotary latch 2 can open in a spring-assisted manner as described.

In the accident operation predominantly depicted in FIG. 2, the blocking element or the coupling lever 12 causes mechanical separation between the actuation lever 8 and the release lever 5 in contrast. In contrast, the previously described normal operation corresponds to the relevant blocking element or the coupling lever 12 ensuring mechanical connection between the actuation lever 8 and the release lever 5, as previously described. As the blocking element 12 is formed as a coupling lever 12 mounted on the actuation lever 8, which pivots in accident operation independently of the actuation lever 8, the blocking element or the coupling lever 12 can assume the two positions illustrated in FIG. 2 compared to the resting position of the coupling lever 12 depicted in dot dashes in normal operation. Both positions of the coupling lever 12 in accident operation correspond to the previously described mechanical separation between the actuation lever 8 and the release lever 5.

The configuration is overall such that the actuation lever spring 14 is equipped with a greater spring force than that of the coupling lever spring 15 is configured. Overall, the spring force constructed by the actuation lever spring 14 does not need to withstand the acceleration forces in accident operation, however. Instead, the actuation lever 8 remains predominantly at rest in accident operation. In contrast, the blocking element or the coupling lever 12 mounted on the actuation lever 8 experiences a pivoting movement as a result of the attacking mass forces which pertain to the two possible positions of the dot-dashed line of the coupling lever 12 in normal operation. This means that the coupling lever 12 is pivotably formed compared to the release lever 5 on both sides in accident operation. Accident operation corresponds to a lateral impact with relevant acceleration forces in the X-direction.

As the coupling lever 12 in accident operation pivots or can pivot compared to the actuation lever 8 which is predominantly not moved as illustrated in FIG. 2, engagement of the ramped contour 16 on the coupling lever 12 with the ramped edge 17 on the release lever 5 no (longer) occurs. Instead, the ramped contour 16 and the ramped edge 17 are disengaged in accident operation. However, should an impingement of the actuation lever 8 occur in the opening direction, the coupling lever 12 pivoted in the dashed or solid position thus ensures respectively that the mechanical connection in accident operation between the actuation lever 8 and the release lever 5 is disrupted in any case. The locking mechanism 1, 2 is consequently not acted on. The illustrated motor vehicle door lock can thus also not be unintentionally opened.

The invention claimed is:

1. A motor vehicle door lock comprising:

a locking mechanism having a pawl and a rotary latch;

a release lever for the locking mechanism;

an actuation lever; and a blocking element, wherein the blocking element, in a normal operation, is configured to cause a mechanical connection between the actuation lever and the release lever and, in an accident operation, mechanical separation between the actuation lever and the release lever, wherein the blocking element is formed as a coupling lever mounted on the actuation lever, which, in the accident operation, the blocking element pivots independently of the actuation lever, wherein the blocking element is acted on by a spring force, wherein a plane defined by the actuation lever including the coupling lever mounted thereon and a plane defined by the release lever are arranged at a right angle to one another.

2. The motor vehicle door lock according to claim 1, wherein the coupling lever includes a coupling lever spring and pivots against a spring force of the coupling lever spring.

3. The motor vehicle door lock according to claim 2, wherein the actuation lever includes an actuation lever spring having a second spring force which is greater than the spring force of the coupling lever spring.

4. The motor vehicle door lock according to claim 1, wherein the coupling lever, in the accident operation, is pivotably formed.

5. The motor vehicle door lock according to claim 1, wherein the coupling lever is mounted on the actuation lever and the actuation lever is arranged in a motor vehicle transverse direction and the release lever is arranged in a motor vehicle lengthwise direction.

6. The motor vehicle door lock according to claim 1, wherein the coupling lever interacts with a ramped edge on the release lever in normal operation.

7. The motor vehicle door lock according to claim 6, wherein the coupling lever has a ramped contour that acts on the ramped edge of the release lever, whereby the release lever is pivoted about a pivot axis.

8. The motor vehicle door lock according to claim 7, wherein the ramped contour and the ramped edge are arranged at a right angle relative to one another.

9. The motor vehicle door lock according to claim 7, wherein during the accident operation, the actuation lever and the coupling lever are configured to pivot independently relative to each other.

10. The motor vehicle door lock according to claim 7, wherein during the accident operation, the ramped contour and the ramped edge are disengaged.

11. The motor vehicle door lock according to claim 7, wherein the ramped contour is arranged in a motor vehicle lengthwise direction and the ramped edge extends in the motor vehicle transverse direction.

12. The motor vehicle door lock according to claim 1, wherein the actuation lever includes a stop element for a connector.

13. The motor vehicle door lock according to claim 12, wherein the stop element is configured to simultaneously act as a stop for a spring leg of an actuation lever spring.

14. The motor vehicle door lock according to claim 12, wherein the connector is configured to mechanically couple the actuation lever and an external handle of the motor vehicle door lock and the stop element is configured to mechanically couple the connector with the actuation lever.

15. The motor vehicle door lock according to claim 1, wherein the actuation lever is formed as a U-shape with the mounted coupling lever.

16. The motor vehicle door lock according to claim 1, wherein during normal operation, the coupling lever is configured for linear movement in response to pivoting movement of the actuation lever.

* * * * *